US011764470B2

(12) United States Patent
Wang et al.

(10) Patent No.: US 11,764,470 B2
(45) Date of Patent: Sep. 19, 2023

(54) PARAMETRIC FLAT LENSES FOR NEAR-FIELD IMAGING AND ELECTRONIC BEAM SCANNING

(71) Applicant: THE REGENTS OF THE UNIVERSITY OF CALIFORNIA, Oakland, CA (US)

(72) Inventors: Yuanxun Ethan Wang, Manhattan Beach, CA (US); Xiating Zou, Los Angeles, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 0 days.

(21) Appl. No.: 18/052,603

(22) Filed: Nov. 4, 2022

(65) Prior Publication Data

US 2023/0170614 A1 Jun. 1, 2023

Related U.S. Application Data

(63) Continuation of application No. PCT/US2021/032248, filed on May 13, 2021.

(60) Provisional application No. 63/024,601, filed on May 14, 2020.

(51) Int. Cl.
*H01Q 3/46* (2006.01)
*H01Q 3/42* (2006.01)

(52) U.S. Cl.
CPC ..... *H01Q 3/46* (2013.01); *H01Q 3/42* (2013.01)

(58) Field of Classification Search
CPC ..... H01Q 3/42; H01Q 3/46
See application file for complete search history.

(56) References Cited

U.S. PATENT DOCUMENTS 4,929,956 A * 5/1990 Lee ..... H01Q 3/2676 342/54
5,861,845 A * 1/1999 Lee ..... H01Q 3/22 342/374
5,926,134 A * 7/1999 Pons ..... H01Q 21/0031 342/368
2008/0297400 A1* 12/2008 Hansen ..... G01S 7/032 342/70

(Continued)

OTHER PUBLICATIONS

ISA/US, United States Patent and Trademark Office (USPTO), International Search Report and Written Opinion dated Sep. 10, 2021, related PCT international application No. PCT/US2021/032248, pp. 1-9, with claims searched, pp. 10-12.

(Continued)

*Primary Examiner* — Awat M Salih
(74) *Attorney, Agent, or Firm* — O'BANION & RITCHEY LLP; John P. O'Banion

(57) ABSTRACT

Parametric flat lenses, which are an alternative to conventional flat lenses, are described for performing near-field imaging and electronic beam scanning. These lenses can electronically direct the near or far fields, and in some cases even achieve a conversion gain. The lens incorporates a plurality of input and output antennas between which are a plurality of parametric mixers. The parametric mixers can be utilized as well to change phase relationships in accommodating different input pattern or directing the output in different ways. The disclosure also describes a proof of concept implementation using off the shelf components.

9 Claims, 5 Drawing Sheets

(56) References Cited

U.S. PATENT DOCUMENTS

2011/0241968 A1* 10/2011 Oota ..... H01Q 25/008
343/853

OTHER PUBLICATIONS

Zou, Xiating et al., "Monolithically Integrated Parametric Mixers With Time-Varying Transmission Lines (TVTLs)", IEEE Transactions on Microwave Theory and Techniques, vol. 68, No. 10, Oct. 2020, pp. 4479-4490, published Aug. 4, 2020.
Hedayati, Maziar et al., "Parametric Downconverter for Mixer-First Receiver Front Ends", IEEE Transactions on Microwave Theory and Techniques, vol. 69, No. 5, May 2021, pp. 2712-2721, published Feb. 19, 2021.

* cited by examiner

PARAMETRIC FLAT LENSES FOR NEAR-FIELD IMAGING AND ELECTRONIC BEAM SCANNING

CROSS-REFERENCE TO RELATED APPLICATIONS

This application claims priority to, and is a 35 U.S.C. § 111(a) continuation of, PCT international application number PCT/US2021/032248 filed on May 13, 2021, incorporated herein by reference in its entirety, which claims priority to, and the benefit of, U.S. provisional patent application Ser. No. 63/024,601 filed on May 14, 2020, incorporated herein by reference in its entirety. Priority is claimed to each of the foregoing applications.

The above-referenced PCT international application was published as PCT International Publication No. WO 2021/231725 A1 on Nov. 18, 2021, which publication is incorporated herein by reference in its entirety.

STATEMENT REGARDING FEDERALLY SPONSORED RESEARCH OR DEVELOPMENT

Not Applicable

NOTICE OF MATERIAL SUBJECT TO COPYRIGHT PROTECTION

A portion of the material in this patent document may be subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND

1. Technical Field

The technology of this disclosure pertains generally to antenna arrays, and more particularly to an antenna array which creates a parametric flat lens for controlling both the near and far field.

2. Background Discussion

Antenna array systems that have reconfigurable focused beams are of significant importance in view of their wide range of applications in both military and commercial communication systems. Conventional lens systems are simple and low-cost, but they are usually nonplanar and can scan beams only through mechanically changing the feed. Reflect array antennas can form a focused beam with planar structures; however, they require special tailoring on each array element, suffer greatly from ohmic losses, and make it difficult to achieve reconfigurable beams. Phased array systems are the most popular way of realizing beam scanning. They usually require complex front-end modules that are expensive to manufacture and are not very power efficient. Conventional flat lenses are based on delay compensation which suffers from significant ohmic loss.

Accordingly a need exists for efficient and reconfigurable focused beam antenna array systems. The present disclosure fulfills that need and provides additional enhancements.

BRIEF SUMMARY

This disclosure describes a parametric flat lens as an alternative to conventional flat lenses. Based on the phase characteristics of parametric mixing, a parametric lens can diffract the near field to form a focused image or steer the far field electronically toward a focal point. Parametric mixing circuitry contained in each antenna element of the lens can achieve a moderate amount of conversion gain which can be applied to compensate for the loss of radiation efficiency or aperture efficiency.

As a proof of concept, a double-balanced parametric mixer was designed based on commercially off-the-shelf varactor diodes. Two parametric lens systems were designed to operate at 1 GHz frequency where the parametric mixer is capable of achieving 6 dB conversion gain. It was found that both beam-focusing and beam-scanning can be realized with low-cost and simple architectures.

Further aspects of the technology described herein will be brought out in the following portions of the specification, wherein the detailed description is for the purpose of fully disclosing preferred embodiments of the technology without placing limitations thereon.

BRIEF DESCRIPTION OF THE SEVERAL VIEWS OF THE DRAWING(S)

The technology described herein will be more fully understood by reference to the following drawings which are for illustrative purposes only:

DETAILED DESCRIPTION

1. Introduction

By way of example, and not of limitation, the technology presented in this disclosure applies the phase reversal property of a parametric mixer in an antenna array system to design a parametric flat lens for near-field imaging and electronic beam scanning. Unlike conventional flat lens systems that suffer from ohmic loss, the presented parametric flat lens can be configured to provide a moderate amount of gain from parametric mixing. Furthermore, in at least one embodiment the parametric flat lens can be configured to utilize spatial power combining to reduce the cost and complexity of a large-scale antenna array system.

2. Theory of Parametric Mixing

Figure 1:
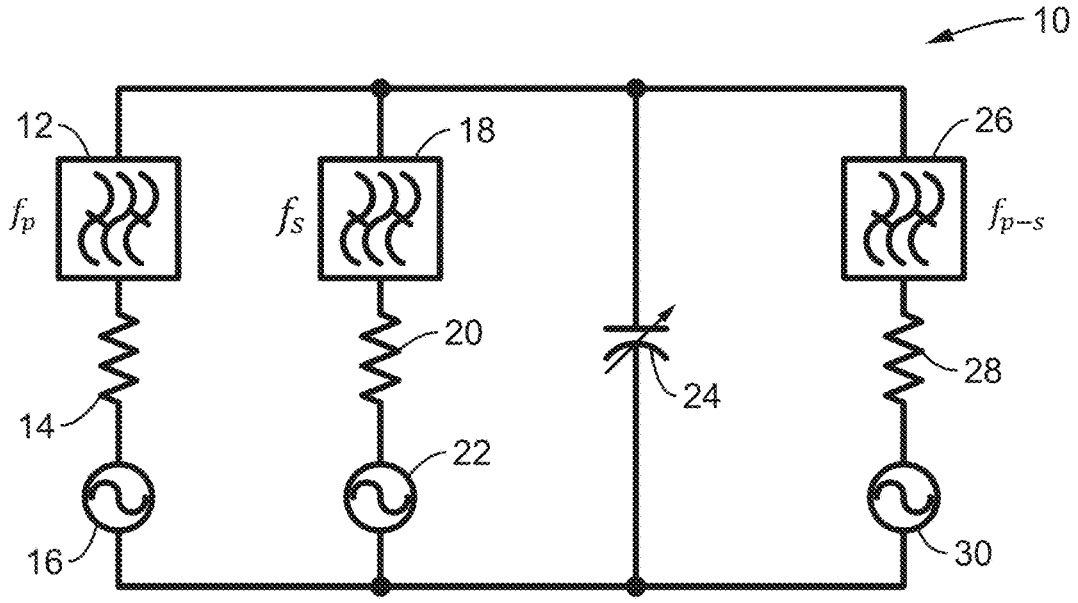
FIG. 1 is a simplified small-signal circuit model of a parametric mixer with time-varying capacitance according to at least one embodiment of the present disclosure.

Parametric mixing is an RF-to-RF conversion process which operates by modulating a nonlinear reactance with a large-signal pump $f_p$. FIG. 1 illustrates an example embodiment 10 of a simplified small-signal model of a parametric mixer with a time-varying capacitor. The figure depicts pump ($f_p$) 12 with source 16 and resistance 14, in parallel with signal ($f_s$) 18 with source 22 and resistance 20, which is in parallel with time variable capacitor 24, with a parallel output ($f_{p-s}$) 26 with its source 30 and resistance 28.

When the large-signal pump introduces a capacitance variation of:

$$C(t)=C_0+2\gamma C_0\cos(2\pi f_p+\varphi_p) \tag{1}$$

where $\gamma$ is the modulation index which quantifies the capacitance variation ratio of the time-varying capacitor, the conversion gain $G_c$ and the phase relationship between the input and output of the parametric mixer can be found by:

$$G_c=\frac{\omega_{p-s}}{\omega_s}\frac{\gamma^2 Q_s Q_p}{(1-\gamma^2 Q_s Q_p)^2} \tag{2}$$

$$\varphi_{p-s}=\varphi p-\varphi_s \tag{3}$$

3. Principles of Operation 3.1 Near-Field Parametric Flat Lens

Figure 2:
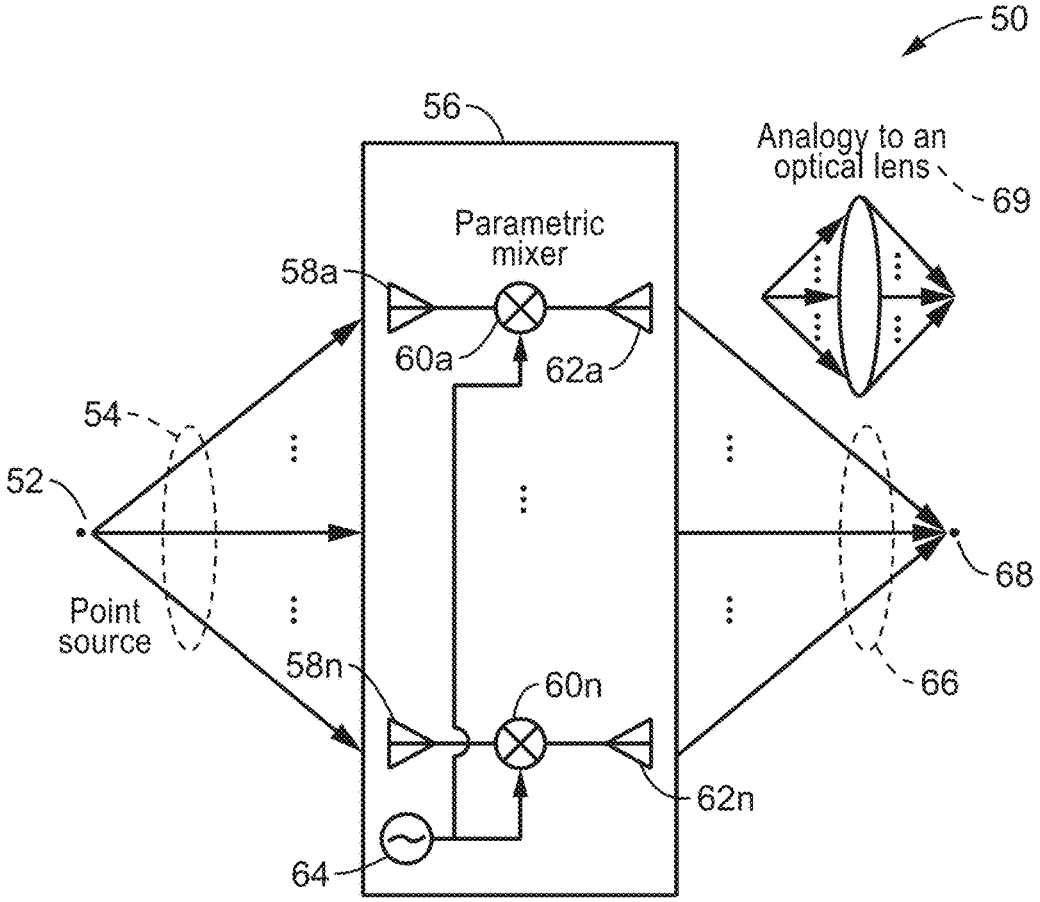
FIG. 2 is a block diagram of a near-field parametric flat lens according to at least one embodiment of the present disclosure.

FIG. 2 illustrates an example embodiment 50 of a near-field parametric flat lens, where diverging rays 54 from a point source 52 are re-directed by parametric mixer 56, acting as a lens, to converge 66 to a spot 68 on the other side. The system has some analogy to an optical lens 69, thus the term lens will be used.

When incoming waves from the left arrive at the parametric mixer (lens) 56, they are captured by the antennas 58*a* through 58*n* on the left and fed to the parametric mixers 60*a* through 60*n*, which are fed output from a local oscillator 64. Each parametric mixer performs phase conjugating on the signal tone, and the converted tone is then re-transmitted by the antennas 62*a* through 62*n* on the right. Since the phase of each ray is flipped, the phase-leading component in the diverging rays now becomes phase-lagging. As a result, the outgoing waves from the flat lens converge to a focal point.

3.2 Far-Field Parametric Flat Lens

Figure 3:
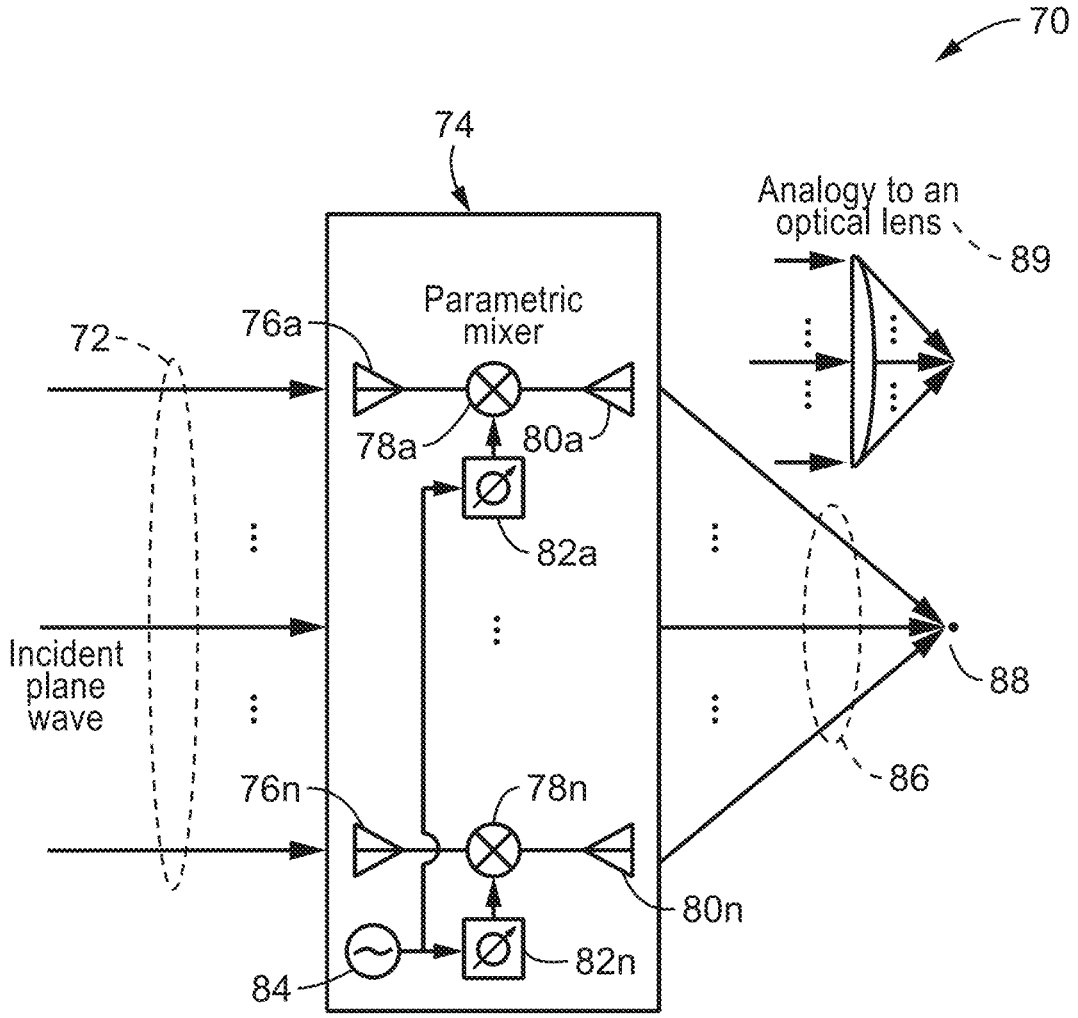
FIG. 3 is a block diagram of a far-field parametric flat lens according to at least one embodiment of the present disclosure.

FIG. 3 illustrates an example embodiment 70 of a far-field parametric flat lens, in which a collimated beam 72 of waves passing through the parametric mixer 74 converges 86 to a point 88 on the other side. This is compared to the analogy of an optical lens 89.

As in the previous example, incoming waves 72 from the left arrive at the parametric mixer (lens) 74, and are captured by antennas 76*a* through 76*n* on the left and fed to the parametric mixers 78*a* through 78*n*, which are fed to the output from a local oscillator 84 which has been phase shifted by phase shifters 82*a* through 82*n*. The converted tone is then re-transmitted by antennas 80*a* through 80*n* on the right of the figure.

Compared with the near-field parametric lens seen in FIG. 2, phase shifters 82*a* through 82*n* are added to: (1) compensate for the quadratic phase error, and (2) for achieving beam steering. For an incoming plane wave with an incident angle $\theta_0$, the total phase shift required by the n-th phase shifter is given by:

$$\varphi_{p,n}=k_{p-s}\left(\sqrt{f^2+x_a^2}-f\right)+k_s\,nd\,\cos(\theta_0) \tag{4}$$

where $k_s$ and $k_{p-s}$ are the free-space propagation constants of the signal and the converted tones, f is the focus of the lens, $x_a$ denotes the coordinate of the antenna array element, and d represents the spacing of the antenna array. It must be noted that, the signal does not see the insertion loss of the phase shifters in the parametric flat lens as opposed to a conventional phased array system, which benefits overall system performance.

It should be appreciated that although FIG. 2 and FIG. 3 illustrate the output directed to a specific point focus output; it can be alternately directed to a plane wave output or any desired convergence/divergence as required by the application to which it is applied.

It should also be appreciated that the parametric lens is bi-directional, thus not only can it receive a plane wave and focus it to a spot, but it can also direct the radiation of a point source from a focal point to a plane wave transmitted to any direction.

4. Parametric Lens Design

Figure 4:
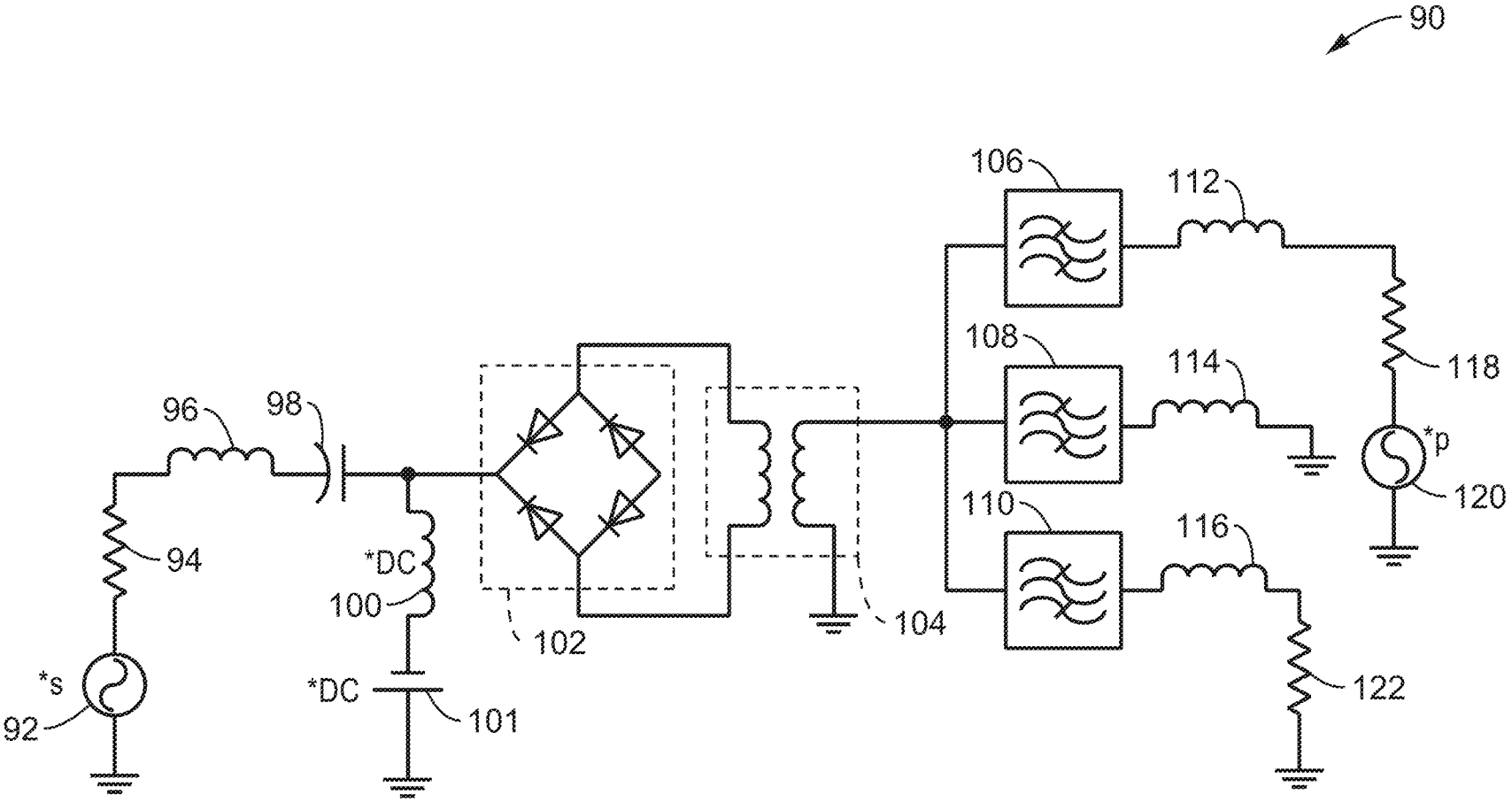
FIG. 4 is a circuit diagram of a double-balanced parametric mixer according to at least one embodiment of the present disclosure.

FIG. 4 illustrates an example embodiment 90 of a proof-of concept design of a double-balanced parametric mixer, with $f_s$=1 GHz and $f_p$=2.1 GHz, which was designed and simulated with Advanced Design System (ADS) harmonic balance simulation.

In the figure is seen an antenna element*s 92 that receives the incident wave, 94 represents the impedance of the antenna (e.g., 50 ohm). inductor 96 (e.g., 40 nH) and capacitor 98 form a narrowband series LC resonator that allows the incoming signal to pass while rejecting the converted signal and the LO signal. Biasing Inductor 100 blocks RF while allowing DC 101 to pass to bias the varactor diode bridge 102 (e.g., MACOM MA46H120 varactor diodes). Diode bridge 102 in combination with transformer 104 forms the double balanced varactor mixer. Narrowband filters 106, 108 and 110 respectively allow only the LO frequency, the upper sideband of the unconverted frequency and the lower sideband of the unconverted frequency to pass. Inductors 112, 114 and 116 (e.g., 8 nH, 7 nH and 21 nH, respectively) provide compensation to the capacitance of the varactor diode at each of the three frequencies. Local Oscillator (LO) signal 120 pumps the parametric mixer to provide the gain needed and provides phase control. Impedance 118 is the source impedance of the LO. Antenna radiation 122 represents antenna radiation of the waves that are amplified and phase shifted to be re-transmitted toward the focal plane or other diffracted directions.

It should be appreciated that the double-balanced mixer of this embodiment, in the form of a diode bridge, is given by way of example and not by limitation; as the parametric mixer of the present disclosure may be implemented in a wide range of configurations without limitation. Other types of mixers may include single-ended varactor diode mixer, or mixers built with magnetic material. On a single-ended mixer, the pump port, the output port and the input port will be connected to a single point after the filters.

Figure 5:
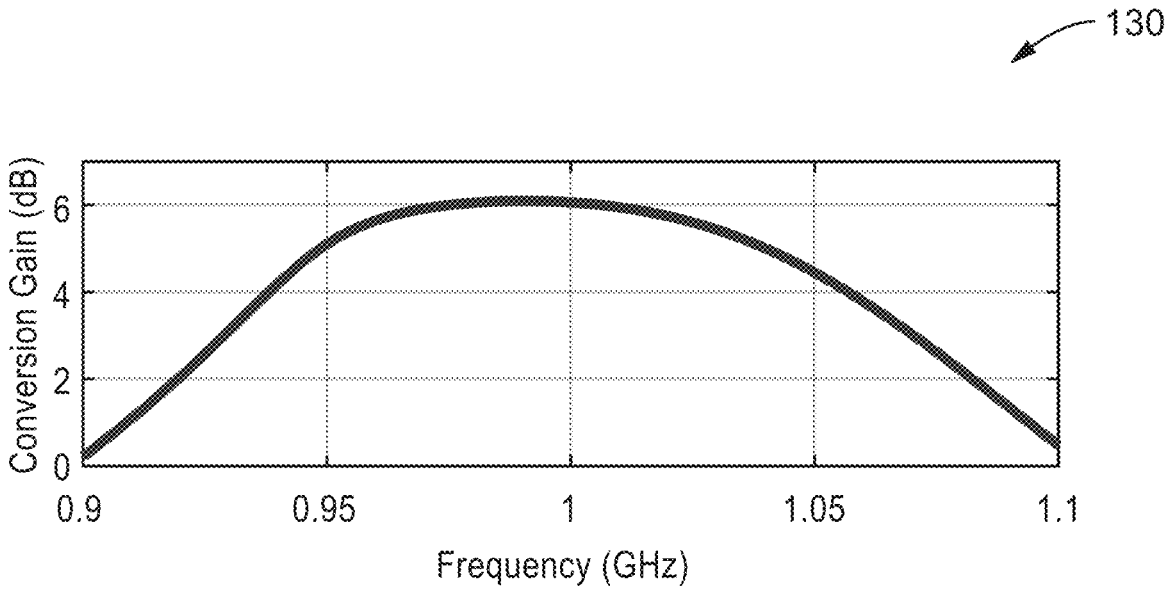
FIG. 5 is a plot of simulated conversion gain of the doubled-balanced parametric mixer as determined according to at least one embodiment of the present disclosure.

FIG. 5 illustrates an example plot 130 showing conversion gain for the circuit of FIG. 4 of 6 dB can be achieved in each parametric mixer when the signal power $P_s$=0 dBm and pump power $P_p$=11 dBm.

Two parametric flat lenses with the aforementioned parametric mixer were designed and simulated with a MATLAB physical optics code. In simulations, the lens had a diameter of $30\lambda_s$, was placed along the x-axis, and was centered at the origin. The spacing of the antenna element is $\lambda_{p-s}/4$ The focal length f was set to be $5\lambda_s$ to provide an f/D=1/6.

Figure 6:
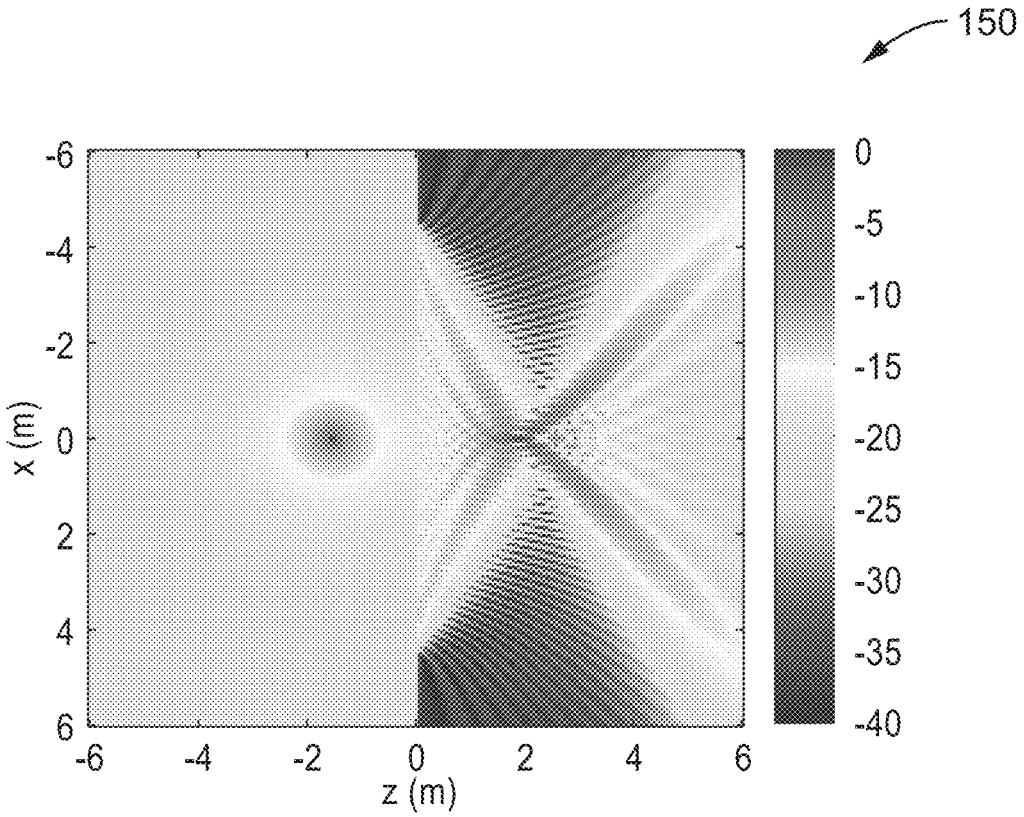
FIG. 6 is an image depicting normalized spatial field distribution of the near-field parametric flat lens according to at least one embodiment of the present disclosure.
Figure 7:
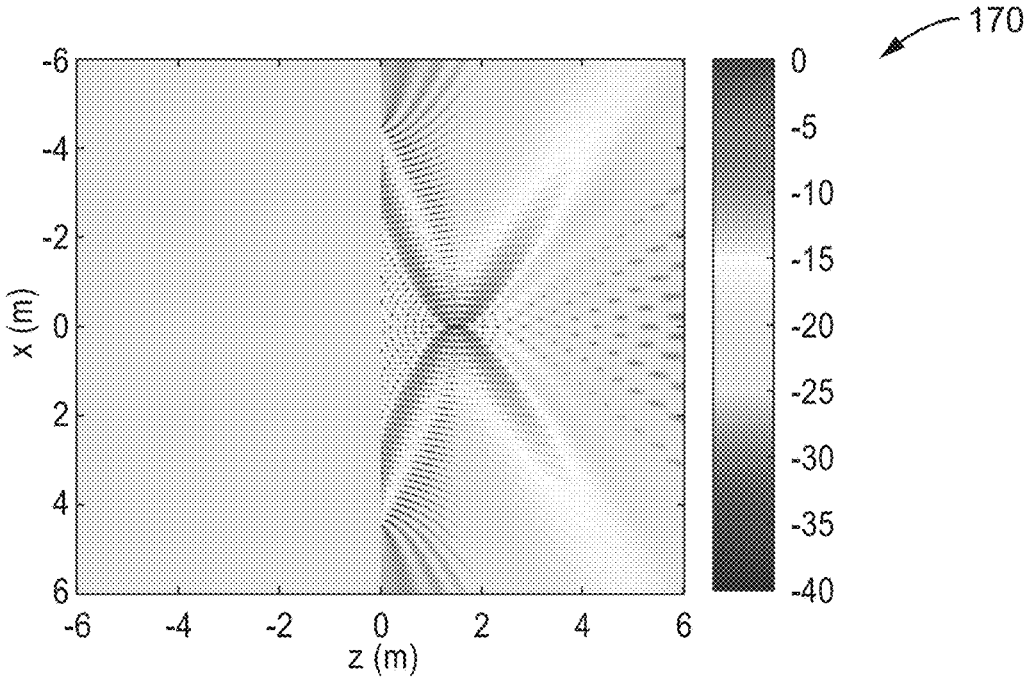
FIG. 7 is an image depicting normalized spatial field distribution of the far-field parametric flat lens according to at least one embodiment of the present disclosure.
Figure 8:
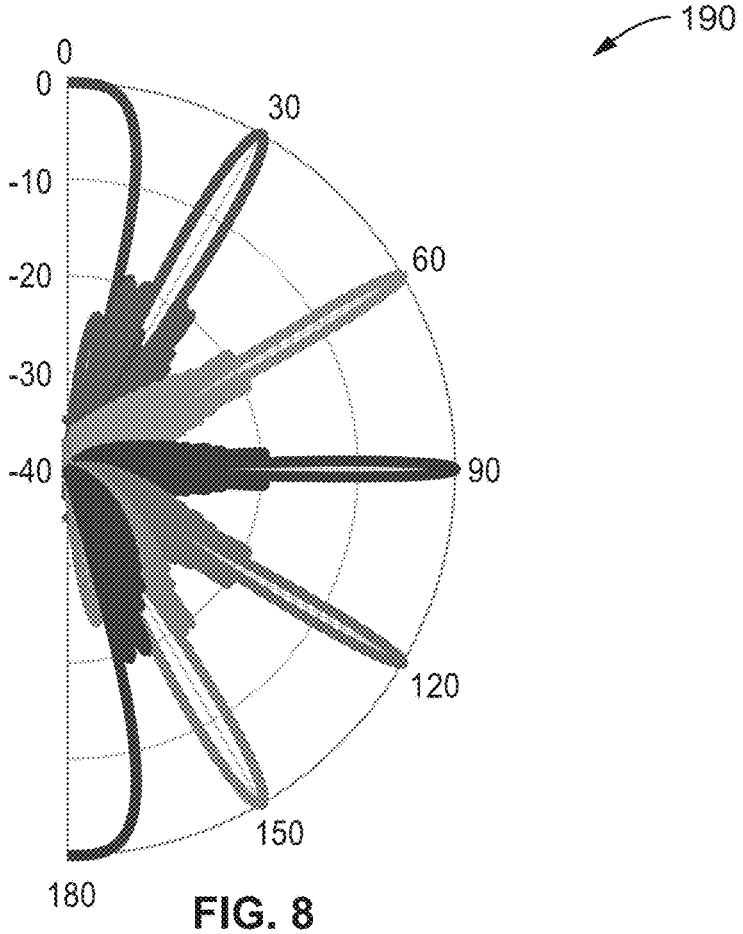
FIG. 8 is a plot of a beam-steering pattern of the far-field parametric flat lens according to at least one embodiment of the present disclosure.

It should be noted that FIG. 6 through FIG. 8 were original represented in colors, and have been converted to gray scale following patent office guidelines.

FIG. 6 illustrates an example field distribution 150 of the near-field parametric flat lens, where the rays from a point source are re-directed by the parametric lens and focus on one spot. If an antenna of size $6\lambda_s$ is utilized to receive the focused beam, then an aperture efficiency of −0.5 dB can be obtained. The LO signal used to pump the lens can operate with the same phase so the output of each mixer in the lens will be phase conjugated to that of the input. It should be appreciated that the focal length can be adjusted and does not need to be the same as the distance between the original source and the center of the lens. In this case, the LO phase needs to be adjusted to compensate for that distance change.

FIG. 7 illustrates an example field distribution 170 of the far-field parametric lens, where the incoming plane wave converges to a point on the other side of the lens. If the same antenna is utilized to capture the focused beam, an aperture efficiency of −1.3 dB can be obtained. This is achieved by adding quadratic phase distribution to the phase of the LO signals. The aperture efficiency can be increased when the focal length is increased as less quadratic phase error is introduced at the price of increased profile.

It should also be appreciated that the mixers and local oscillator and circuits between the local oscillator and each mixer, can be configured for programmed control (e.g., under the control of the processor that is directing beam steering and parameters of the lensing)—so that the function of the device can be changed on the fly or to adopt to different applications. Various adaptive mechanisms may also be incorporated with the mixers to further control operation; for example to redirect adaptations based on external conditions. In addition, a neural net(s) (neural processing) can be incorporated to redirect lensing and adaptations based on what is detected at the input "image", thus expanding the field of applications.

FIG. 8 illustrates a plot 190 which demonstrates the beam-steering capability of the far-field parametric lens, showing the beam being steered to 0, 30, 60, 90, 120, 150 and 180 degrees by way of example and not limitation.

It should be appreciated that the above lensing configuration being based on an antenna array whose elements are controllable in groups or more preferably individually, can readily perform scanning functions. In particular, to enable beam scanning, a linear phase slope, in additional to the quadratic phase distribution can be added to the phase of the LO. These phases will be passed to the outputs through the parametric mixer. This steers the antenna beam at the input and directs the outgoing wave to the same focal point.

Embodiments of the present technology may be described herein with reference to flowchart illustrations of methods and systems according to embodiments of the technology, and/or procedures, algorithms, steps, operations, formulae, or other computational depictions, which may also be implemented as computer program products. In this regard, each block or step of a flowchart, and combinations of blocks (and/or steps) in a flowchart, as well as any procedure, algorithm, step, operation, formula, or computational depiction can be implemented by various means, such as hardware, firmware, and/or software including one or more computer program instructions embodied in computer-readable program code. As will be appreciated, any such computer program instructions may be executed by one or more computer processors, including without limitation a general purpose computer or special purpose computer, or other programmable processing apparatus to produce a machine, such that the computer program instructions which execute on the computer processor(s) or other programmable processing apparatus create means for implementing the function(s) specified.

Accordingly, blocks of the flowcharts, and procedures, algorithms, steps, operations, formulae, or computational depictions described herein support combinations of means for performing the specified function(s), combinations of steps for performing the specified function(s), and computer program instructions, such as embodied in computer-readable program code logic means, for performing the specified function(s). It will also be understood that each block of the flowchart illustrations, as well as any procedures, algorithms, steps, operations, formulae, or computational depictions and combinations thereof described herein, can be implemented by special purpose hardware-based computer systems which perform the specified function(s) or step(s), or combinations of special purpose hardware and computer-readable program code.

Furthermore, these computer program instructions, such as embodied in computer-readable program code, may also be stored in one or more computer-readable memory or memory devices that can direct a computer processor or other programmable processing apparatus to function in a particular manner, such that the instructions stored in the computer-readable memory or memory devices produce an article of manufacture including instruction means which implement the function specified in the block(s) of the flowchart(s). The computer program instructions may also be executed by a computer processor or other programmable processing apparatus to cause a series of operational steps to be performed on the computer processor or other programmable processing apparatus to produce a computer-implemented process such that the instructions which execute on the computer processor or other programmable processing apparatus provide steps for implementing the functions specified in the block(s) of the flowchart(s), procedure (s) algorithm(s), step(s), operation(s), formula(e), or computational depiction(s).

It will further be appreciated that the terms "programming" or "program executable" as used herein refer to one or more instructions that can be executed by one or more computer processors to perform one or more functions as described herein. The instructions can be embodied in software, in firmware, or in a combination of software and firmware. The instructions can be stored local to the device in non-transitory media, or can be stored remotely such as on a server, or all or a portion of the instructions can be stored locally and remotely. Instructions stored remotely can be downloaded (pushed) to the device by user initiation, or automatically based on one or more factors.

It will further be appreciated that as used herein, that the terms processor, hardware processor, computer processor, central processing unit (CPU), and computer are used synonymously to denote a device capable of executing the instructions and communicating with input/output interfaces and/or peripheral devices, and that the terms processor, hardware processor, computer processor, CPU, and computer are intended to encompass single or multiple devices, single core and multicore devices, and variations thereof.

From the description herein, it will be appreciated that the present disclosure encompasses multiple implementations of the technology which include, but are not limited to, the following:

A parametric flat lens apparatus, comprising: (a) a plurality of input antennas on an input side of said parametric flat lens configured for receiving incoming signal rays; (b) a plurality of output antennas on an output side of said parametric flat lens configured for generating outgoing signal rays; and (c) a plurality of parametric mixers, wherein an input of each parametric mixer is coupled to an input antenna of said plurality of input antennas and an output of each parametric mixer is coupled to an output antenna of said plurality of output antennas; (g) wherein incoming waves are received on the input side of said parametric flat lens and are received as incoming signal rays by the input antennas and redirected by said parametric mixers through said output antennas as outgoing signal rays to a spot on the output side of said parametric flat lens.

A parametric lens apparatus, comprising: (a) a plurality of input antennas; (b) a plurality of output antennas; (c) a plurality of parametric mixers; and (d) each parametric mixer having an input side coupled to an input antenna of said plurality of input antennas and having an output side coupled to an output antenna of said plurality of output antennas; (e) wherein said parametric lens is configured for receiving diverging rays from a point source at said input antennas whose signals are passed to said parametric mixers; (f) wherein each parametric mixer is configured for performing phase conjugating on a signal tone received by the parametric mixer and passes the phase conjugated signal tone to a corresponding output antenna for retransmission; and (g) wherein said plurality of parametric mixers in said parametric lens is configured for flipping phase of each ray wherein phase-leading components in diverging rays become phase-lagging, and outgoing signal rays are directed to a desired convergence/divergence and location on the output side of said parametric lens.

A parametric lens apparatus, comprising: (a) a plurality of input antennas; (b) a plurality of output antennas; (c) a plurality of parametric mixers and associated phase shifters; (d) each parametric mixer having an input side coupled to an input antenna of said plurality of input antennas and having an output side coupled to an output antenna of said plurality of output antennas; (e) wherein collimated rays from a point source are received at said input antennas and are passed to said parametric mixers; (f) wherein each parametric mixer is configured for performing phase conjugating on a signal tone received by said parametric mixer and passing the phase conjugated signal tone to a corresponding output antenna for retransmission; and (g) wherein said plurality of parametric mixers in said parametric flat lens is configured for flipping said phase of each ray wherein phase-leading components in diverging rays become phase-lagging, and outgoing rays converge to a focal point.

A parametric flat lens apparatus, comprising: (a) an input side; (b) an output side; (c) a plurality of input antennas on the input side; (d) a plurality of output antennas on the output side; (e) a plurality of parametric mixers; (f) each parametric mixer coupled to an input antenna of said plurality of input antennas and an output antenna of said plurality of output antennas; (g) wherein incoming waves on the input side are received by the input antennas and redirected by said parametric mixers through said output antennas to a spot on the output side.

A parametric flat lens apparatus, comprising: (a) a plurality of input antennas; (b) a plurality of output antennas; (c) a plurality of parametric mixers; (d) each parametric mixer coupled to an input antenna of said plurality of input antennas and an output antenna of said plurality of output antennas; (e) wherein diverging rays from a point source are received said input antennas are passed to said parametric mixers; (f) wherein each parametric mixer performs phase conjugating on a signal tone received by the parametric mixer and passes the phase conjugated signal tone to a corresponding output antenna for retransmission; (g) wherein phase of each ray is flipped, phase-leading components in diverging rays become phase-lagging, and outgoing rays converge to a focal point.

A parametric flat lens apparatus, comprising: (a) a plurality of input antennas; (b) a plurality of output antennas; (c) a plurality of parametric mixers and associated phase shifters; (d) each parametric mixer coupled to an input antenna of said plurality of input antennas and an output antenna of said plurality of output antennas; (e) wherein collimated rays from a point source are received said input antennas are passed to said parametric mixers; (f) wherein each parametric mixer performs phase conjugating on a signal tone received by the parametric mixer and passes the phase conjugated signal tone to a corresponding output antenna for retransmission; (g) wherein phase of each ray is flipped, phase-leading components in diverging rays become phase-lagging, and outgoing rays converge to a focal point.

The apparatus of any preceding implementation, wherein each parametric mixer of said plurality of parametric mixers provide phase reversal properties which operate to focus the output from said plurality of output antennas.

The apparatus of any preceding implementation, wherein each parametric mixer of said plurality of parametric mixers is configured for performing phase conjugating on a signal tone received by the parametric mixer and passes the phase conjugated signal tone to a corresponding output antenna for retransmission.

The apparatus of any preceding implementation, wherein each parametric mixer of said plurality of parametric mixers is configured for flipping phase of each incoming ray wherein phase-leading components in diverging rays become phase-lagging, and outgoing rays converge to a focal point.

The apparatus of any preceding implementation, wherein said plurality of input antennas are directed for receiving incoming waves from a point source or a planar source.

The apparatus of any preceding implementation, wherein said plurality of output antennas are directed for transmitting outgoing waves toward a point or in a planar output.

The apparatus of any preceding implementation, wherein said parametric lens is bi-directional.

As used herein, term "implementation" is intended to include, without limitation, embodiments, examples, or other forms of practicing the technology described herein.

As used herein, the singular terms "a," "an," and "the" may include plural referents unless the context clearly dictates otherwise. Reference to an object in the singular is not intended to mean "one and only one" unless explicitly so stated, but rather "one or more."

Phrasing constructs, such as "A, B and/or C", within the present disclosure describe where either A, B, or C can be present, or any combination of items A, B and C. Phrasing constructs indicating, such as "at least one of" followed by listing a group of elements, indicates that at least one of these group elements is present, which includes any possible combination of the listed elements as applicable.

References in this disclosure referring to "an embodiment", "at least one embodiment" or similar embodiment wording indicates that a particular feature, structure, or characteristic described in connection with a described embodiment is included in at least one embodiment of the present disclosure. Thus, these various embodiment phrases are not necessarily all referring to the same embodiment, or to a specific embodiment which differs from all the other embodiments being described. The embodiment phrasing should be construed to mean that the particular features, structures, or characteristics of a given embodiment may be combined in any suitable manner in one or more embodiments of the disclosed apparatus, system or method.

As used herein, the term "set" refers to a collection of one or more objects. Thus, for example, a set of objects can include a single object or multiple objects.

Relational terms such as first and second, top and bottom, and the like may be used solely to distinguish one entity or action from another entity or action without necessarily requiring or implying any actual such relationship or order between such entities or actions.

The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element.

As used herein, the terms "approximately", "approximate", "substantially", "essentially", and "about", or any other version thereof, are used to describe and account for small variations. When used in conjunction with an event or circumstance, the terms can refer to instances in which the event or circumstance occurs precisely as well as instances in which the event or circumstance occurs to a close approximation. When used in conjunction with a numerical value, the terms can refer to a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, "substantially" aligned can refer to a range of angular variation of less than or equal to ±10°, such as less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°.

Additionally, amounts, ratios, and other numerical values may sometimes be presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified. For example, a ratio in the range of about 1 to about 200 should be understood to include the explicitly recited limits of about 1 and about 200, but also to include individual ratios such as about 2, about 3, and about 4, and sub-ranges such as about 10 to about 50, about 20 to about 100, and so forth.

The term "coupled" as used herein is defined as connected, although not necessarily directly and not necessarily mechanically. A device or structure that is "configured" in a certain way is configured in at least that way, but may also be configured in ways that are not listed.

Benefits, advantages, solutions to problems, and any element(s) that may cause any benefit, advantage, or solution to occur or become more pronounced are not to be construed as a critical, required, or essential features or elements of the technology describes herein or any or all the claims.

In addition, in the foregoing disclosure various features may be grouped together in various embodiments for the purpose of streamlining the disclosure. This method of disclosure is not to be interpreted as reflecting an intention that the claimed embodiments require more features than are expressly recited in each claim. Inventive subject matter can lie in less than all features of a single disclosed embodiment.

The abstract of the disclosure is provided to allow the reader to quickly ascertain the nature of the technical disclosure. It is submitted with the understanding that it will not be used to interpret or limit the scope or meaning of the claims.

It will be appreciated that the practice of some jurisdictions may require deletion of one or more portions of the disclosure after that application is filed. Accordingly the reader should consult the application as filed for the original content of the disclosure. Any deletion of content of the disclosure should not be construed as a disclaimer, forfeiture or dedication to the public of any subject matter of the application as originally filed.

The following claims are hereby incorporated into the disclosure, with each claim standing on its own as a separately claimed subject matter.

Although the description herein contains many details, these should not be construed as limiting the scope of the disclosure but as merely providing illustrations of some of the presently preferred embodiments. Therefore, it will be appreciated that the scope of the disclosure fully encompasses other embodiments which may become obvious to those skilled in the art.

All structural and functional equivalents to the elements of the disclosed embodiments that are known to those of ordinary skill in the art are expressly incorporated herein by reference and are intended to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

What is claimed is:

1. A parametric lens apparatus, comprising:

(a) a plurality of input antennas on an input side of said parametric lens configured for receiving incoming signal rays;

(b) a plurality of output antennas on an output side of said parametric lens configured for generating outgoing signal rays; and (c) a plurality of parametric mixers, wherein an input of each parametric mixer is coupled to an input antenna of said plurality of input antennas and an output of each parametric mixer is coupled to an output antenna of said plurality of output antennas;

(g) wherein incoming waves are received on the input side of said parametric lens are received as incoming signal rays by the input antennas and redirected by said parametric mixers through said output antennas as outgoing signal rays are directed to a desired convergence/divergence and location on the output side of said parametric lens.

2. The apparatus of claim 1, wherein each parametric mixer of said plurality of parametric mixers provide phase reversal properties which operate to focus the output from said plurality of output antennas.

3. The apparatus of claim 1, wherein each parametric mixer of said plurality of parametric mixers is configured for performing phase conjugating on a signal tone received by the parametric mixer and passes the phase conjugated signal tone to a corresponding output antenna for retransmission.

4. The apparatus of claim 1, wherein said each parametric mixer of said plurality of parametric mixers is configured for flipping phase of each incoming ray wherein phase-leading components in diverging rays become phase-lagging, and outgoing rays converge to a focal point.

5. The apparatus of claim 1, wherein said plurality of input antennas are directed for receiving incoming waves from a point source or a planar source.

6. The apparatus of claim 1, wherein said plurality of output antennas are directed for transmitting outgoing waves toward a point or in a planar output.

7. The apparatus of claim 1, wherein said parametric lens is bi-directional.

8. A parametric flat lens apparatus, comprising:

(a) a plurality of input antennas;

(b) a plurality of output antennas;

(c) a plurality of parametric mixers; and (d) each parametric mixer having an input side coupled to an input antenna of said plurality of input antennas and having an output side coupled to an output antenna of said plurality of output antennas;

(e) wherein said parametric flat lens is configured for receiving diverging rays from a point source at said input antennas whose signals are passed to said parametric mixers;

(f) wherein each parametric mixer is configured for performing phase conjugating on a signal tone received by the parametric mixer and passes the phase conjugated signal tone to a corresponding output antenna for retransmission; and (g) wherein said plurality of parametric mixers in said parametric flat lens is configured for flipping phase of each ray wherein phase-leading components in diverging rays become phase-lagging, and outgoing rays converge to a focal point.

9. A parametric flat lens apparatus, comprising:

(a) a plurality of input antennas;

(b) a plurality of output antennas;

(c) a plurality of parametric mixers and associated phase shifters;

(d) each parametric mixer having an input side coupled to an input antenna of said plurality of input antennas and having an output side coupled to an output antenna of said plurality of output antennas;

(e) wherein collimated rays from a point source are received at said input antennas are passed to said parametric mixers;

(f) wherein each parametric mixer is configured for performing phase conjugating on a signal tone received by said parametric mixer and passing the phase conjugated signal tone to a corresponding output antenna for retransmission; and (g) wherein said plurality of parametric mixers in said parametric flat lens is configured for flipping said phase of each ray wherein phase-leading components in diverging rays become phase-lagging, and outgoing rays converge to a focal point.

* * * * *